United States Patent [19]

Dingler

[11] 4,301,822

[45] Nov. 24, 1981

[54] WATER CENTERED CONE UPPER SPRAY ARM FOR DISHWASHERS

[75] Inventor: Geoffrey L. Dingler, St. Joseph Township, Berrien County, Mich.

[73] Assignee: Whirlpool Corporation, Benton Harbor, Mich.

[21] Appl. No.: 166,082

[22] Filed: Jul. 3, 1980

[51] Int. Cl.[3] ..... B08B 3/02

[52] U.S. Cl. ..... 134/176; 134/154; 134/183; 239/259; 308/72

[58] Field of Search ..... 134/144, 149, 154, 175–177, 134/179–180, 183; 239/243, 245–246, 259, 261, 264; 308/72, 140–141

[56] References Cited

U.S. PATENT DOCUMENTS

| | | | |
|---|---|---|---|
| 1,053,715 | 2/1913 | Cromwell | 308/141 |
| 1,977,763 | 10/1934 | Gordon | 239/259 |
| 3,091,400 | 5/1963 | Aubert | 239/264 X |
| 3,180,348 | 4/1965 | Clearman | 134/176 |
| 3,363,950 | 1/1968 | Cole | 308/72 |
| 3,854,762 | 12/1974 | Spiegel | 292/197 |
| 3,876,148 | 4/1975 | Cushing et al. | 134/179 X |
| 3,951,684 | 4/1976 | La Prad et al. | 134/144 |
| 4,174,723 | 11/1979 | Long | 134/144 |
| 4,266,565 | 5/1981 | Gurubatham | 134/144 |

*Primary Examiner*—Robert L. Bleutge

*Attorney, Agent, or Firm*—Wegner, Stellman, McCord, Wood & Dalton

[57] ABSTRACT

A self-aligning water jet receiver for a rotary spray arm rotatable about an axis of rotation on a dishwasher dish rack in which the rotatable spray arm is mounted on the dish rack and is rotated by the reaction force of water exiting through spray nozzles in the spray arm. An upwardly projected water jet supplies the water to the hollow spray arm. In this invention the liquid jet is received in a jet receiver that is mounted on the spray arm along the axis of rotation and is shiftable laterally by the force of the jet on the receiver to align the receiver coaxially with the jet.

13 Claims, 3 Drawing Figures

39
41
40
38
37
34
32
53
36
33
32
29
29
27
42
43
28
35
46
45
44
26
59
58
66
66a
67
64
76
66a
65
73
47
72
75
65
49
68
69
70
54
57
56
48
55
52
24

WATER CENTERED CONE UPPER SPRAY ARM FOR DISHWASHERS

BACKGROUND OF THE INVENTION

This invention is directed to dishwashers and particularly those having upper and lower racks and separate spray arms associated with each rack. In the dishwasher of this invention as well as those of U.S. Pat. Nos. 3,180,348 and 3,854,762 and 4,266,565, all assigned to the assignee hereof, there is described a dishwasher having an upper rack on which is mounted a rotatable spray arm that is rotated by the reaction forces of spaced and inclined spray nozzles which also serve to spray washing and rinsing liquid over dishes held in the upper rack.

The rotatable spray arm is provided with liquid by an upwardly projected jet of liquid that enters a receiver and then flows into and through the spray arm, thereby providing the force necessary to project the liquid through the nozzles.

One of the problems with a dishwasher or similar article washing apparatus is the centering of the liquid receiver in the upper rack with respect to the axis of the projected jet, particularly when the axis of rotation of the spray arm and attached receiver is offset from the central axis of the projected jet.

In the above U.S. Pat. No. 4,266,565, there is disclosed a structure in which the entire upper spray arm and integral jet receiver is shifted laterally to accommodate this non-alignment so that the lateral shifting is intended to make the axis of rotation and the central axis of the jet coincide.

The most pertinent prior art of which applicant is aware are U.S. Pat. Nos. 1,053,715; 3,180,348; 3,363,950 and 3,876,148.

Of these, U.S. Pat. No. 1,053,715 discloses a rotary shaft B mounted for rotation in a bearing D, with the bearing having a capacity for movement about its horizontal axis for self-alignment.

U.S. Pat. No. 3,180,348 discloses a dishwasher with an upper spray arm receiver for an upwardly directed jet of liquid, the upper spray arm being manually adjustable for alignment.

U.S. Pat. No. 3,363,950 discloses a motor mounted on self-aligning bearings which are movable in the axis of rotation of the shaft.

U.S. Pat. No. 3,876,148 discloses means for mounting and moving a spray arm in a dishwasher so that the nozzles of the spray arm move in a non-repeating epicyclic spray path as a result of the mounting structure for the spray arm.

SUMMARY OF THE INVENTION

To correct the problem of the misalignment of the axis of the liquid receiver for the upper spray arm with respect to the axis of the projected liquid jet, the present invention provides a receiver for the liquid jet mounted on the upper spray arm with this receiver having a central axis generally coinciding with the axis of rotation of the arm. Means are provided for mounting this receiver on the spray arm for lateral shifting of the receiver by the force exerted on the receiver by the jet for self-alignment of the receiver coaxially with the jet.

The spray arm rotates about a fixed axis and even if the receiver is out of axial alignment with the axis of rotation of the spray arm the force of the jet will tend to hold the receiver in coaxial position with respect to the jet. The result is that the receiver will "walk around" the rotating spray arm to maintain its coaxial alignment with the jet while the spray arm rotates about its own axis parallel to but spaced from the axis of the jet and the receiver.

In the illustrated embodiment of the invention the receiver is of small mass so that self-alignment of the receiver axis with the liquid jet axis is almost instantaneous.

In addition, the receiver is provided with a retainer which is held within a hollow mounting member having a mounting member plate through which the receiver extends and enclosing the retainer for relative movement between the retainer and the mounting member plate. The liquid pressure within the hollow mounting member causes the retainer to be pressed against the plate to inhibit leakage through the enlarged opening provided in the plate while permitting the lateral shifting of the receiver for the self-aligning function.

DESCRIPTION OF THE PREFERRED EMBODIMENT

Figure 1:
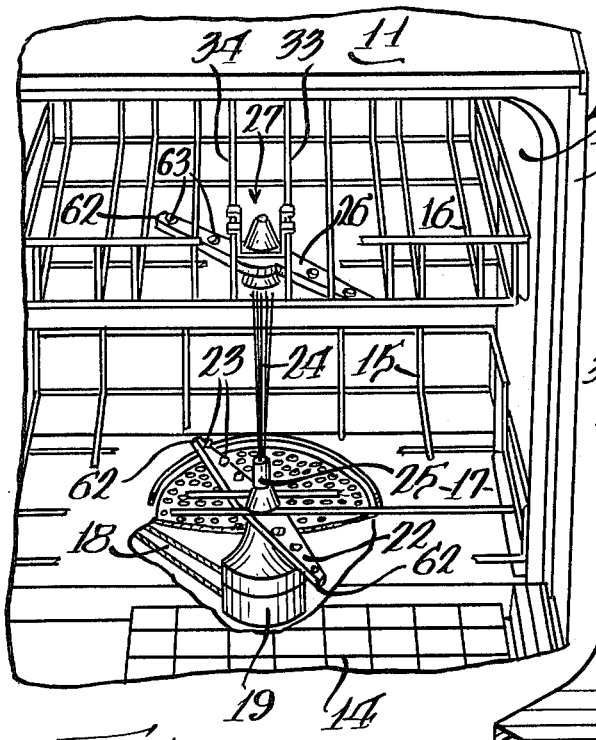
FIG. 1 is a perspective view, partially broken away, of the interior of a dishwasher embodying the invention.

In the embodiment of the invention shown in FIG. 1, the dishwasher 10 is of the front loading type and comprises a top wall 11 of a cabinet 12 that includes an interior washing cavity 13 and a front door 14 that is pivotable from the generally horizontal open position as shown to a vertical closed position. Mounted within the cavity 13 are a lower open dish rack 15 and an upper open dish rack 16. As is customary, each of these racks is transversely movable to a projecting position generally exterior of the cabinet for loading and unloading.

Located in a bottom portion 17 of the cavity 13 is a sump 18 for collecting liquid for recirculation. This liquid is recirculated from the sump by a motor driven pump 19 with a portion of this liquid being directed to the interior of a lower spray arm 22. The spray arm 22 has inclined nozzles 23 that simultaneously cause reaction rotation of the arm 22 and direct the liquid over dishes (not shown) in the lower rack 15.

The pump 19 directs another portion of the liquid in a jet 24 by way of a vertical nozzle or tower 25.

Mounted on the upper rack 16, at least approximately coaxial with the axis of the jet 24, is an upper spray arm 26. The spray arm 26 is mounted to the upper dish rack 16 by a bearing structure 27. This structure comprises a stationary mount 28 comprising four upwardly extending attachment arms 29 as shown most clearly in the exploded view of FIG. 2. Each arm 29 has on its upper end an outwardly facing substantially semicircular notch 32. As shown in FIG. 3, each pair of notches 32 is adapted to engage a horizontal wire 33 or 34 of the upper rack 16.

Figure 2:
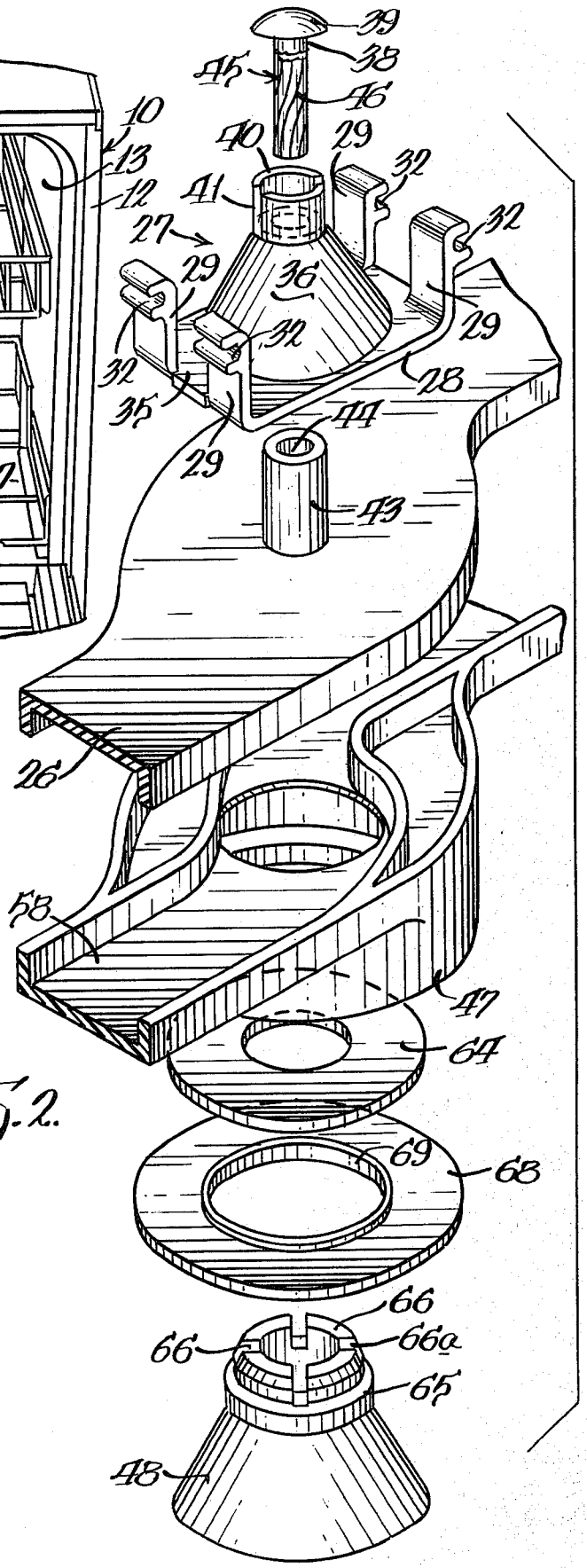
FIG. 2 is a fragmentary, exploded, perspective view of a liquid jet receiver and associated structure of the embodiment of FIG. 1.
Figure 3:
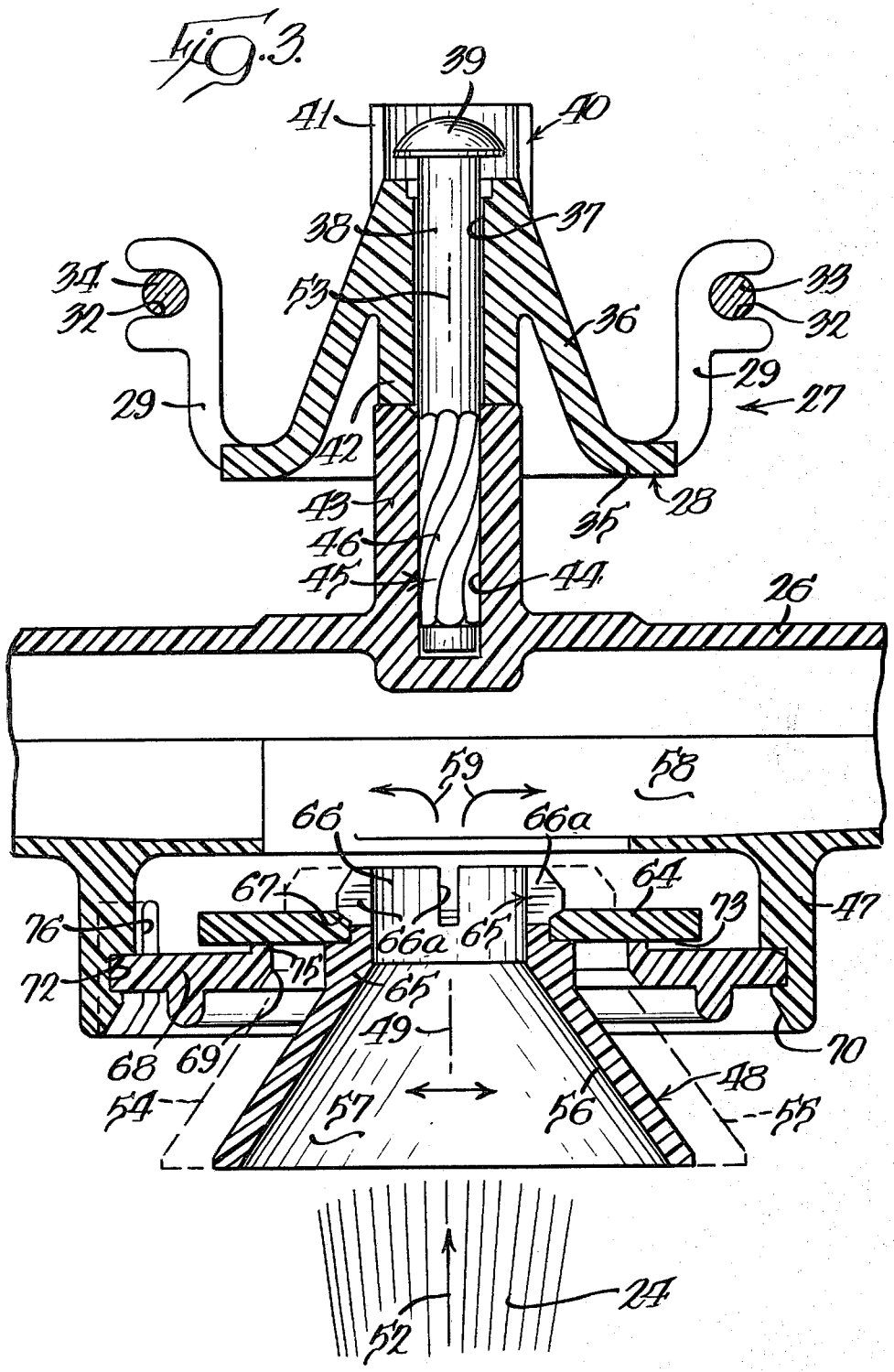
FIG. 3 is a vertical axial sectional view through the assembled receiver of FIG. 1.

Referring to FIGS. 2 and 3, the arms 29, which are supported by the rack wires 33 and 34, in turn support a generally rectangular platform 35 that is integral and concentric with a truncated upwardly extending conical portion 36. This portion 36 is provided concentrically thereof with a bearing portion 42 forming a vertical bore 37 which receives the shank of a vertical connecting pin 38. The pin has on its upper end an enlarged head 39 that has a diameter that is larger than that of the bore 37. This pin 38 has a length that is greater than the overall length of the vertical bore 37. The length of vertical bore 37 is sufficient to prevent tilting of the pin 38 that would allow contact of the spray arm with the upper rack. The length of the pin 38 is greater than the total length of the bearing portion 42 that contains the vertical bore 37. The head 39 is protected within a collar shield 40 having side slits 41 to allow drainage of any liquid received within the shield 40.

The spray arm 26 has an upwardly extending projection 43 which includes a blind hole 44 of a size sufficient to grip tightly a serrated bottom end 45 of the pin 38. Thus the hole 44 in projection 43 is smaller in diameter than the vertical bore 37 in which the upper shank portion of the pin 38 is received.

In assembly, the pin 38 is driven into the spray arm blind hole 44 so that helical serrations 46 formed on the bottom end 45 grip the projection 43 at the surface forming the hole 44. With this arrangement the spray arm 26 is loosely connected to the stationary mount 28, permitting relative rotation between the spray arm and the mount. In other words, the spray arm 26 and the pin 38 rotate about an axis 53 as a unit relative to the mount 28.

Formed integrally with the spray arm 26, as can be seen most clearly in FIG. 3, is a hollow generally cylindrical mounting member 47 for supporting and retaining a receiver 48 for the upwardly projected liquid jet 24. This receiver 48 has a central axis 49 generally coinciding with the axis of rotation 53 and under ideal conditions coincides with a central axis 52 of the liquid jet. The receiver 48 is mounted within the mounting member 47, and thus on the spray arm 26, for lateral shifting relative to the axis of rotation 53 of the spray arm. This shifting, which may be between the two extremes illustrated by the broken lines 54 and 55 in FIG. 3, is accomplished by having a conical surface 56 flaring downwardly and outwardly from the spray arm and open at the bottom to receive the liquid jet 24. The jet entering the thusly defined conical bottom space 57 creates horizontal components of force on the conical surface 56 to move the receiver 48 into axial alignment with the axis 52 of the jet. This movement is quite rapid because the mass of the entire receiver 48 is quite small.

The upper spray arm 26 extends laterally of its axis of rotation 53 and has a hollow interior 58 for receiving the pressurized liquid from the receiver for flow laterally as indicated by the arrows 59 to the outer ends 62 of the spray arm 26. Positioned along the arm 26 are the customary spray nozzles 63 that are angled toward the rack 16 for simultaneously imparting reaction rotation to the spray arm 26 and spraying dishes and the like retained in the rack 16.

In order to retain the receiver 48 as shown in FIGS. 2 and 3, a mounting means is provided including the mounting member 47, a retainer plate 64 and a mounting member plate 68. The annular flat retainer plate 64 is attached to an upper concentric cylindrical hub 65 on the receiver 48. This hub is provided with four vertical open ended slots 66*a* formed by cylindrical portions 66, each of the cylindrical portions provided on its outer surface with a shoulder 67 so that the retainer 64 can be snapped into retained engagement around the hub 65 as shown in FIG. 3. When so engaged the retainer plate 64 is within the mounting member 47 and the retainer and the attached receiver are held in this position by a mounting member plate 68. The mounting member plate 68 forms a central circular opening 69 having a raised lip 75 around the circumference thereof. The hub 65 extends through the opening 69 with the hub 65 being concentric with the plate 68 and axis of rotation 53 when all the parts are properly aligned.

However, the central circular opening 69 is considerably larger in diameter than the diameter of the hub 65 in order to permit the lateral shifting and self-alignment of the receiver 48 when the axis of the jet 52 is out of alignment with the axis 49 of the receiver 48. As stated earlier, the retainer plate 64 is snapped into position on the slotted hub 65. Similarly, the mounting member plate 68 is snapped into position adjacent the bottom of the cylindrical mounting member 47 by reason of an annular inwardly opening groove 72 that is engaged by the circular edge of the plate 68 that is guided to this position by the annular sloped surface 70.

A slot 76 is provided in the mounting member 47. When the spray arm is pressurized by the inflow of water from the liquid jet 24 the slot acts as a spray nozzle similarly to nozzles 63. Further, the slot 76 allows for the escape of food particles from the mounting member 47, preventing food particle build up on mounting member plate 68 that would restrict the movement of receiver 48.

With the parts assembled as illustrated in FIGS. 1 and 3, the upwardly projected liquid jet 24 enters the conical open space 57 of the receiver 48 and from there flows through the hub 65 into the interior of the mounting member 47 and into the hollow interior of the spray arm 58 as indicated by the arrows 59. Because of the liquid pressure within the mounting member 47, the retainer plate 64 has its bottom surface 73 pressed firmly into engagement with a top surface 74 of lip 75, thereby reducing leakage through the relatively larger opening 69, to provide maximum liquid pressure within the hollow interior 58 of the spray arm 26.

Where the receiver 48 is in coaxial alignment with the axis of the liquid jet 24 and the axis of rotation 53 of the spray arm, the parts rotate in the position illustrated in FIG. 3. However, where the jet axis 52 is out of alignment with the axis of rotation 53, the horizontal component of liquid force on the conical surface 56 causes the relatively low mass receiver 48 to immediately shift laterally between the extremes indicated by the broken lines 54 and 55 to bring the axes 49 and 52 into alignment. Under these circumstances the aligned axes 49 and 52 are laterally spaced from the axis of rotation 53, but the full force of the liquid 59 will enter the hollow interior 58 for maximum force rotation of the spray arm 26. The rotation of the spray arm tends to move the receiver 48 eccentrically about axis 53 so that the force of the rotation moment working against the force created by the jet 24 against the surface 56 will cause the receiver 48 to "walk" around the hollow interior of the mounting means 47. This is caused by the force of the jet 24 bearing against the conical surface 56 of receiver 48, urging it toward alignment of the axes 49 and 52, while at the same time the eccentric arrangement of the axes 49 and 53 tends to move the receiver 48 out of alignment with the jet 24. Because the mass of the receiver 48 is very small, and there is minimal frictional drag between the lip top surface 74 and a bottom surface 73 of retainer plate 64, the alignment of the axes 49 and 52 is substantially maintained at all times so that the full force of the jet 24 can enter the spray arm 56 and be projected through the nozzles 63 against articles such as dishes (not shown) held in the rack 16.

I claim:

1. An article washing apparatus comprising:

(a) a cabinet;

(b) an open article holder in said cabinet;

(c) a rotary spray arm mounted on said open article holder and rotatable about an axis of rotation;

(d) means for projecting a liquid jet generally coaxial with said axis of rotation of said spray arm;

(e) a jet receiver on said spray arm, said receiver having a central axis generally coinciding with said axis of rotation for receiving the projected liquid jet;

(f) means for mounting said receiver on said spray arm for lateral shifting of the receiver relative to the axis of rotation of the spray arm, said receiver laterally movable by a force exerted on said receiver by said jet for self-alignment of the receiver coaxially with said jet; and (g) cooperating liquid flow means on said receiver and said spray arm for directing liquid from said receiver over articles held in said article holder.

2. The apparatus of claim 1 wherein said receiver is provided with a conical surface flaring downwardly and outwardly relative to said spray arm, said surface contacted by said jet to create a lateral component of force on the receiver, thereby causing said lateral shifting self-alignment of the receiver.

3. The apparatus of claim 1 wherein said spray arm extends laterally of said axis of rotation and is provided with a hollow interior means for receiving pressurized liquid from said receiver, said flow means including a plurality of nozzle means spaced along said arm communicating with said hollow interior and angled with respect to the axis of rotation of the spray arm for imparting rotational moment force to the spray arm.

4. The apparatus of claim 1 wherein said receiver is located above said jet and comprises an open downwardly and outwardly flaring jet receiving portion, said mounting means comprising a retainer attached to said receiver and a hollow mounting member having a mounting member plate enclosing said retainer for relative movement between the retainer and the mounting member plate.

5. The apparatus of claim 4 wherein said retainer and mounting member plate have slidably engaged surface portions extending laterally of said axis of rotation.

6. The apparatus of claim 5 wherein said mounting member plate comprises a wall having an opening through which a mounting portion of said receiver extends and of a lateral extent greater than said mounting portion.

7. An article washing apparatus comprising:

(a) a cabinet;

(b) an open article holder in said cabinet;

(c) a rotary spray arm mounted on said open article holder and rotatable about an axis of rotation;

(d) means for projecting a liquid jet generally coaxial with said axis of rotation of said spray arm;

(e) a jet receiver on said spray arm, said receiver having a central axis generally coinciding with said axis of rotation for receiving the projected liquid jet, said receiver comprising a downwardly and outwardly flaring, jet receiving, surface forming an open portion;

(f) means for mounting said receiver on said spray arm for lateral shifting of the receiver relative to the axis of rotation of the said spray arm, said receiver laterally movable by a force exerted on said receiver by said jet for self-alignment of the receiver coaxially with said jet, said mounting means comprising a retainer attached to said receiver and a hollow mounting member having a mounting member plate enclosing said retainer for relative movement between the retainer and the mounting member; and (g) cooperating liquid flow means on said receiver and said spray arm for directing liquid from said retainer over articles held in said article holder by way of said spray arm, said retainer and mounting member plate having slidably engaged surface portions extending laterally of said axis of rotation, said mounting member plate comprising a wall having an opening through which a mounting portion of said receiver extends, said opening having a lateral extent greater than said mounting portion.

8. The apparatus of claim 7 wherein said receiver flaring surface is contacted by said jet whenever said jet does not coincide with the axes of said arm and said receiver to create a lateral component of force on the receiver thereby causing said lateral shifting self-alignment of the receiver.

9. The apparatus of claim 7 wherein said spray arm extends laterally of said axis of rotation and is provided with a hollow interior means for receiving pressurized liquid from said receiver, said flow means including a plurality of nozzle means spaced along said arm communicating with said hollow interior and angled with respect to the axis of rotation of the spray arm for imparting rotational moment force to the spray arm.

10. The apparatus of claim 7 wherein said receiver and said retainer combined are of relatively small mass so that the receiver self-centers substantially instantaneously upon engagement with said jet.

11. The apparatus of claim 7 wherein said mounting member plate engaged surface comprises a raised lip contacting said retainer to reduce the frictional contact between said plate and retainer, so that the receiver self-centers substantially instantaneously upon engagement with said jet.

12. The apparatus of claim 11 wherein said retainer is subjected directly to liquid pressure within said hollow mounting member whereby the retainer is pressed tightly against said lip to inhibit leakage of liquid from said hollow mounting member through said wall opening.

13. In an article washing apparatus having a cabinet, an open article holder in said cabinet, a rotary spray arm mounted on said open article holder and rotatable about an axis of rotation, and pump, means for projecting a liquid generally coaxial with said axis of rotation of said spray arm, a self-aligning water jet receiver means for said spray arm comprising:

(a) a jet receiver on said spray arm, said receiver having a central axis generally coinciding with said axis of rotation for receiving the projected liquid jet;

(b) means for mounting said receiver on said spray arm for lateral shifting of the receiver relative to the axis of rotation of the spray arm, said receiver laterally movable by a force exerted on said receiver by said jet for self-alignment of the receiver coaxially with said jet;

(c) cooperating liquid flow means on said receiver and said spray arm for directing liquid from said receiver over articles held in said article holder by way of said spray arm; and (d) at least one nozzle means on said receiver mounting means for allowing soil particles to escape from said mounting means.

* * * * *